US005655609A

United States Patent [19]

Brown et al.

[11] Patent Number: 5,655,609

[45] Date of Patent: Aug. 12, 1997

[54] EXTENSION AND RETRACTION MECHANISM FOR SUBSURFACE DRILLING EQUIPMENT

[75] Inventors: David Allen Brown, New Caney; Lee M. Smith, Houston, both of Tex.

[73] Assignee: Baroid Technology, Inc., Houston, Tex.

[21] Appl. No.: 586,045

[22] Filed: Jan. 16, 1996

[51] Int. Cl.[6] ..... E21B 7/06

[52] U.S. Cl. ..... 175/76; 175/325.1

[58] Field of Search ..... 175/73, 76, 325.1, 175/325.2, 325.4, 266

[56] References Cited

U.S. PATENT DOCUMENTS

| | | | |
|---|---|---|---|
| 1,604,200 | 10/1926 | Shaw . | |
| 1,738,860 | 12/1929 | Wigle . | |
| 2,713,473 | 7/1955 | Talbot . | |
| 2,820,610 | 1/1958 | Martinez . | |
| 3,051,255 | 8/1962 | Deely . | |
| 3,180,436 | 4/1965 | Kellner et al. . | |
| 3,308,895 | 3/1967 | Oxford et al. . | |
| 4,270,619 | 6/1981 | Base . | |
| 4,388,974 | 6/1983 | Jone, Jr. et al. . | |
| 4,416,339 | 11/1983 | Baker et al. . | |
| 4,471,843 | 9/1984 | Jones, Jr. et al. . | |
| 4,606,417 | 8/1986 | Webb et al. . | |
| 4,635,736 | 1/1987 | Shirley . | |
| 4,681,160 | 7/1987 | Fineberg . | |
| 4,690,229 | 9/1987 | Raney . | |
| 4,693,328 | 9/1987 | Furse et al. . | |
| 4,776,397 | 10/1988 | Akkerman . | |
| 4,848,490 | 7/1989 | Anderson | 175/325.4 X |
| 5,181,576 | 1/1993 | Askew et al. . | |
| 5,186,264 | 2/1993 | du Chaffaut | 175/76 X |
| 5,265,684 | 11/1993 | Rosenhauch . | |
| 5,311,953 | 5/1994 | Walker . | |
| 5,467,834 | 11/1995 | Hughes et al. | 175/325.1 X |
| 5,511,627 | 4/1996 | Anderson | 175/325.2 X |
| 5,520,255 | 5/1996 | Barr et al. | 175/73 X |
| 5,582,259 | 12/1996 | Barr | 175/73 |
| 5,582,260 | 12/1996 | Murer et al. | 175/76 |

FOREIGN PATENT DOCUMENTS

| | | |
|---|---|---|
| 0159573 | 10/1985 | European Pat. Off. . |
| 1554989 | 1/1969 | France . |
| 2431023 | 2/1980 | France . |
| 481690 | 7/1973 | U.S.S.R. . |
| 751956 | 7/1978 | U.S.S.R. . |
| 2211446 | 7/1989 | United Kingdom . |
| 9109202 | 6/1991 | WIPO . |
| 94/13928 | 6/1994 | WIPO . |

*Primary Examiner*—Frank Tsay
*Attorney, Agent, or Firm*—Browning Bushman

[57] ABSTRACT

A centralizing tool for use in drilling an earth borehole. Drilling fluid pressure extends contact members radially from the tool into engagement with the borehole walls. A timing wheel engages each of the contact members to coordinate their radial movement. A fluid driven tubular central piston extending through the timing wheel causes the wheel to rotate as the piston is moved axially through the tool. High fluid pressure drives the contact members radially outwardly and moves the piston axially to compress a central coil spring surrounding the piston. Reduction of the drilling fluid pressure allows the spring force to return the piston to its initial axial position which rotates the timing wheel to retract the contact elements.

11 Claims, 2 Drawing Sheets

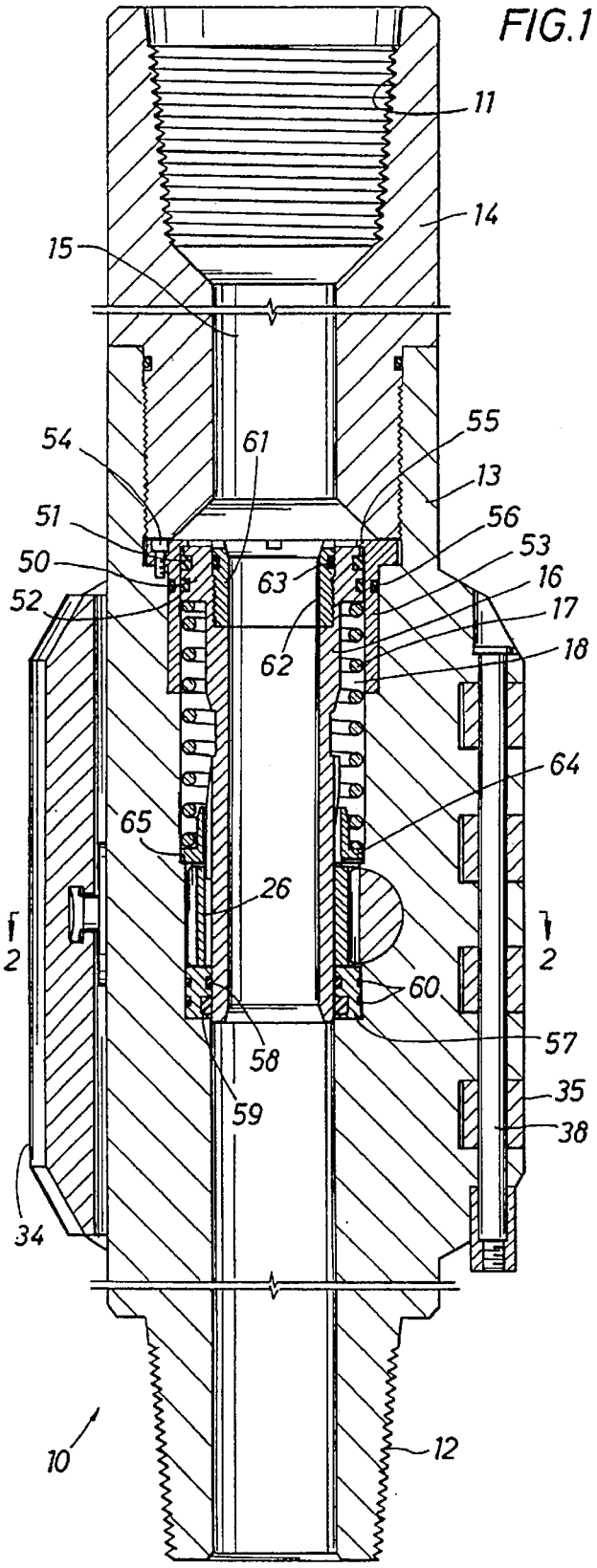
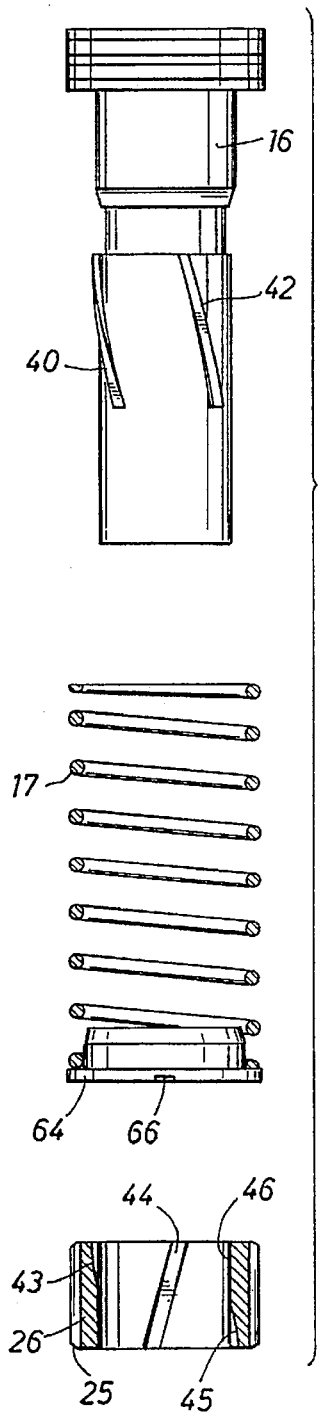
FIG. 4

EXTENSION AND RETRACTION MECHANISM FOR SUBSURFACE DRILLING EQUIPMENT

FIELD OF THE INVENTION

The present invention relates to downhole tools used in the drilling and working over of wells. More specifically, the present invention relates to an adjustable centralizing tool that responds to the application of drilling fluid pressure to automatically extend centralizing contact arms into engagement with the wall of a surrounding well borehole to centralize the tool within the borehole. A specific embodiment of the invention includes an improved mechanism for positively retracting the centralizing contact arms of the tool.

BACKGROUND OF THE INVENTION

Centralizing downhole tools are employed in both rotary drilling and in fluid motor drilling applications to maintain a uniform well borehole size and to control the direction of hole development. Downhole tools used in drilling are preferably selected with diameters that closely approximate the diameter of the hole within which the tools are to be employed. Tools that automatically change their diametric dimensions to adapt to varying hole sizes have also been used for this purpose.

An example of a tool that automatically extends stabilizing arms to adapt the tool to a variable diameter borehole is described in Applicant's International application Ser. No. PCT/BE93/00073 filed Dec. 3, 1993. The cited prior art tool employs the drilling fluid pressure to drive several laterally movable pistons against contact arms that pivot out from the tool into engagement with the surrounding borehole wall. A central tubular piston converts the drilling fluid pressure to a hydraulic pressure that acts against the lateral pistons. A timing wheel connects the lateral pistons to each other to coordinate their lateral movement. The outward movement of the lateral pistons compresses individual springs positioned about each lateral piston to assist in retracting the pistons and connected contact arms when the drilling fluid pressure is reduced.

Retraction of the pistons and engaged contact arms in the prior art device is dependent upon the spring forces acting on the individual lateral pistons and on the pressure differential acting across the pistons. In some applications, these spring and pressure induced forces may not be adequate to ensure full retraction of the contact arms.

SUMMARY OF THE INVENTION

A self centering drilling stabilizer having radially extendable contact arms is provided with an improved retraction mechanism for retracting the arms. In operation, the arms are pushed radially outwardly into contact with the well bore by the pressure of drilling fluid being pumped through the tool. The extended arms keep the tool centered in the well bore so long as the drilling fluid is exerting sufficient pressure. The fluid pressure used to extend the arms is also employed to compress a coil spring which is centered around a central tubular piston. The stored energy in the compressed spring is employed to retract the arms when the fluid pressure is reduced.

An important feature of the present invention is the provision of a mechanical linkage between the arms and the spring to positively retract the arms with the restoring force of the compressed spring. In a preferred form of the invention, the mechanical linkage is provided by a spline and groove connection between the central tubular piston and a timing gear surrounding a rod section of the central piston. The tubular piston is driven axially through the tool under the influence of the pressurized drilling fluid flowing through the central opening in the tubular piston. This movement pressurizes hydraulic fluid behind the central piston which in turn displaces lateral arm actuating pistons connected to the contact arms. The spring which encircles the piston rod is compressed by the piston movement. The spline and groove connection between the central piston rod and the timing gear forces the timing gear to rotate about the tool axis as the central piston is moved through the tool. Rack teeth on the piston rods of the laterally disposed actuating pistons connect with the timing gear teeth in a rack and pinion type drive to cause the contact arms to move radially as the gear rotates.

The timing gear and arm drive connection ensures that the arms move in unison and to the same degree and also provides the driving force for retracting the arms. The latter movement occurs when the drilling fluid pressure is reduced and the compressed spring drives the central piston back to its initial, de-energized position. The return movement of the central piston under the influence of the compressed spring rotates the timing gear and draws the lateral pistons and connected contact arms back into the tool.

An important advantage of the retraction mechanism of the present invention is the provision of a strong and positive retraction force which draws back the extended arms even against the restriction of wall cake, cuttings or other solid material present in the well bore.

Another important feature of the retraction mechanism of the present invention is that the central piston is firmly engaged in the tool cylinder so that it resists rotation within the cylinder but is nevertheless free to move axially through the cylinder. The fit of the piston within the cylinder is such that the rotary force required to cause the timing gear to rotate is less than the rotary force required to rotate the central piston within the cylinder bore. The result is that the central piston moves axially without rotating thereby causing the timing gear to rotate.

Still another feature of the present invention is that the retraction mechanism is effective in retracting the arms with the force of the compressed coiled spring even if the hydraulic fluid pressure used to activate the mechanism is lost due to seal damage or other malfunction.

From the foregoing it will be appreciated that a primary object of the present invention is to provide a centralizing tool with a positive drive retraction mechanism that employs the force of pressurized drilling fluid to compress a spring during the extension of centralizing arms in the tool and that uses the stored force of the compressed spring to retract the centralizing arms when the drilling fluid pressure is decreased.

Another important object of the present invention is the provision of a mechanical linkage between a fluid driven axially movable central piston and a surrounding rotatably movable timing gear to ensure that axial non-rotational movement of the piston produces rotational movement of the timing gear whereby radially movable centralizing arms connected with the timing gear are forced to move radially in response to the axial movement of the piston.

Still another object of the present invention is to provide an energy storage system that is energized by the pressurized drilling fluid and is operative when the drilling fluid pressure is reduced to drive the central piston axially through the tool causing the timing gear to rotate and retract the centralizing arms.

It is an object of the present invention to provide a tool having the foregoing features without the requirement for extensive modification of existing centralizing tool designs and without the need for complex mechanisms and additional components.

These and further objects, features and advantages of the present invention will become apparent from the following detailed description, wherein reference is made to the figures in the accompanying drawings.

BRIEF DESCRIPTION OF THE DRAWINGS

FIG. 1 is a vertical cross-sectional elevation of the extension and retraction mechanism of the present invention;

FIG. 4 is an expanded, isometric assembly view illustrating details in the mechanical linkage between the coil spring, tubular piston and timing gear of the present invention.

DETAILED DESCRIPTION OF THE PREFERRED EMBODIMENTS

Figure 2:
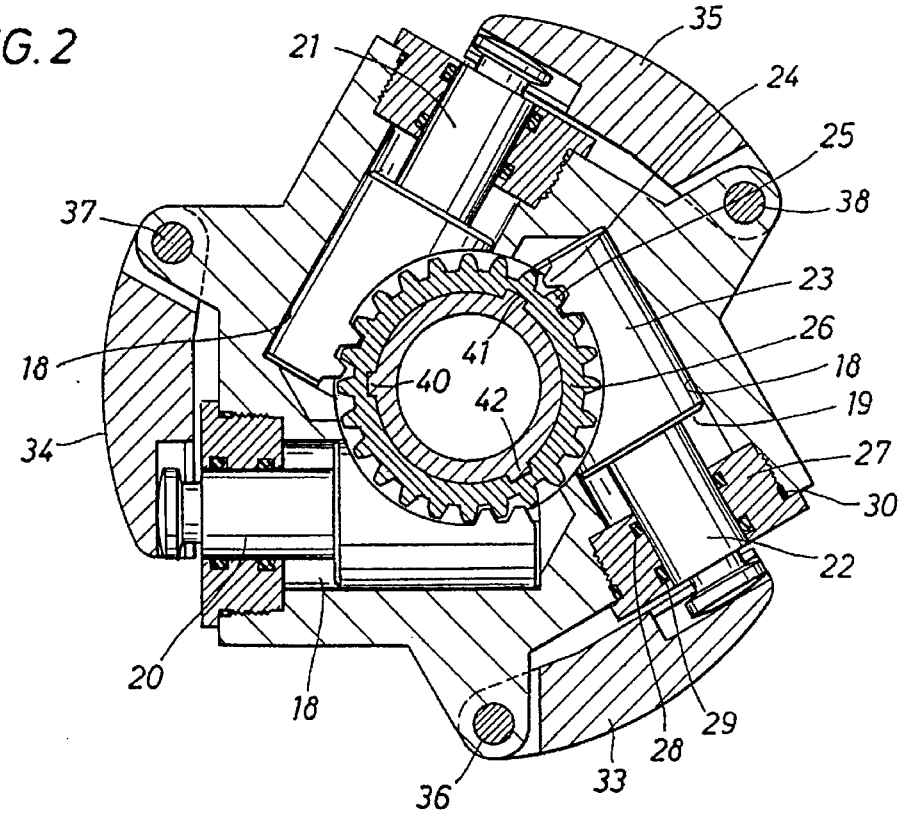
FIG. 2 is a horizontal cross-sectional view of the invention taken along the line 2—2 of FIG. 1 and illustrating the contact arms in their retracted positions.

A preferred form of the invention is indicated generally in FIG. 1 as an axially extending drilling centralizer 10. The centralizer 10 has an internally threaded box 11 at its upper end and an externally threaded pin 12 at its lower end which are designed to mate with corresponding connections in a conventional drill string assembly. The centralizer 10 is adapted to function as a subsurface component in the drill string assembly to centralize a drill bit or a rotary bit motor or other drill stem device within a bore hole.

The centralizer 10 includes an axially extending central tubular body 13 that is threadedly mated with an upper box sub-assembly 14. An axially extending central flow passage 15 is provided through the centralizer 10 to conduct drilling fluid to a drill bit or other device (not illustrated) connected below the centralizer.

A tubular piston 16, carded centrally within the body 13, is adapted to be moved axially downwardly through the body 13 under the influence of pressurized drilling fluid in the passage 15. This downward piston movement compresses a coil spring 17 which returns the piston 16 to the starting position illustrated in FIG. 1 when the drilling fluid pressure is reduced.

The area surrounding the piston 16 forms a sealed hydraulic chamber 18 that is filled with a fluid such as hydraulic oil. The downward movement of the piston pressurizes the oil in the hydraulic chamber 18 to force lateral actuator pistons 19, 20 and 21 (FIGS. 2 and 3) to move laterally out of the chamber 18 under the influence of the hydraulic pressure.

The actuator pistons, such as the piston 19, each include a cylindrical piston head 22 and a rod section 23. The rod section 23 is equipped with gear teeth 24 that engage gear teeth 25 on a central timing gear wheel 26. The gear teeth 24 of the rod 23 cooperate with the gear teeth 25 of the timing gear 26 to produce a rack and pinion drive in which lateral movement of the actuator piston 22 is accompanied by rotary movement of the gear wheel 26. Similar rack and pinion drives between the gear 26 and the actuator pistons 20 and 21 cooperate so that all three actuator pistons are advanced or retracted laterally to the same degree and at the same time.

Each of the actuator pistons is surrounded by an annular seal carrier such as the carrier 27 which in turn is bolted or otherwise suitably secured to the central body 13. An annular pressure seal 28 permits sliding and sealing engagement with the piston head 22 while maintaining a pressure seal to contain the hydraulic oil in the chamber 18. An annular wiper seal 29 functions to wipe drilling fluid residue from the piston head 22 during the piston's retraction to maintain a clean sealing surface for the pressure seal 28. An outer o-ring seal 30 provides a pressure seal between the seal carrier 27 and the tubular body 13 to prevent escape of the hydraulic oil from the chamber 18.

The top end of each of the piston's heads, such as the piston head 22, is equipped with a T-shaped coupler 31 which engages a T-shaped slot 32 in the free end of a contact arm such as the contact arm 33. Three contact arms, 33, 34 and 35 are carried on the centralizer 10 and each connects to a cylinder in a similar manner as the arm 33. The arms 33, 34 and 35 are pivotably mounted at their fixed ends by pivot pins 36, 37 and 38, respectively.

Figure 3:
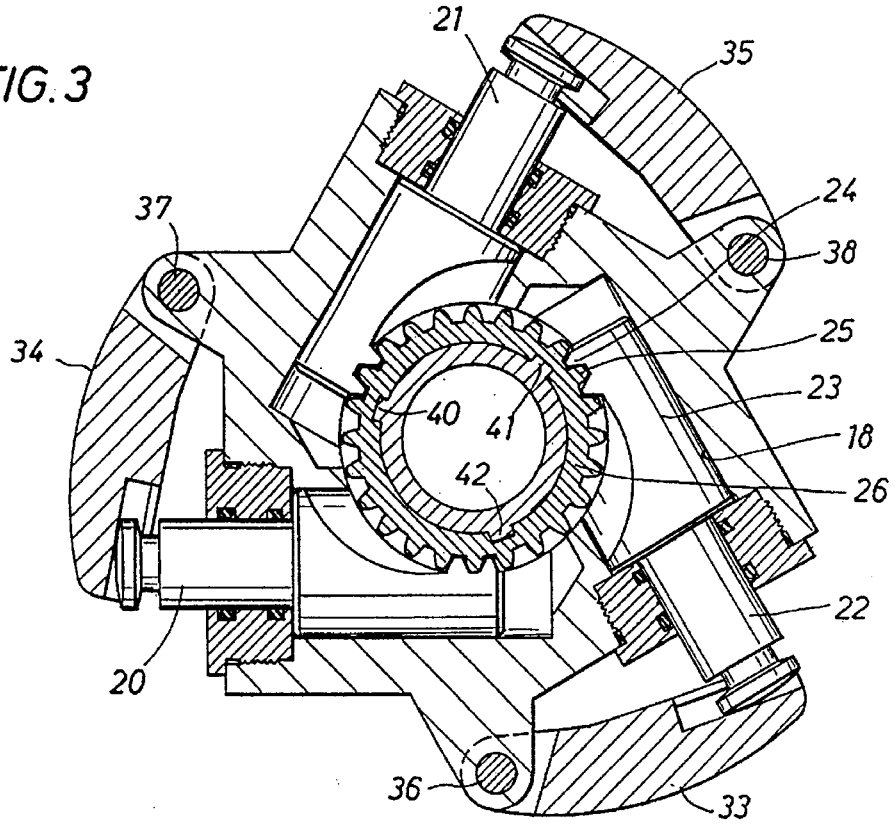
FIG. 3 is a view similar to FIG. 2 illustrating the contact arms in their extended positions.

As illustrated best in FIGS. 2 and 3, movement of the pistons 20, 21 and 22 laterally away from the central axis of the centralizer 10 swings the arms 34, 35 and 33 out to increase the effective lateral cross-sectional dimensions of the centralizer. The engagement of the rack gear teeth, such as the teeth 24, of each piston with the timing gear teeth 25 causes the timing gear 26 to rotate, which ensures that each piston 20, 21 and 22 and connected arm 34, 35 and 33, respectively, move at the same time and to the same degree.

With joint reference to FIGS. 3 and 4, it may be seen that the central piston 16 is equipped with inclined splines 40, 41 and 42 that are adapted to mate with corresponding inclined grooves 43, 44 and 45, respectively, formed in a central shaft opening 46 of the timing gear 26. As will be more fully described, engagement of the inclined splines 40, 41 and 42 in the grooves 43, 44 and 45 forces the timing gear 26 to rotate as the piston 16 is moved axially, without rotating, up or down through the gear 26.

The central piston 26 includes a piston head 50 (FIG. 1) that is equipped with an upper annular wiper seal 51 and a lower annular pressure seal 52. A bore sleeve 53 surrounding the piston head 50 is held in place by bolts 54 that extend into tapped bolt holes formed in the centralizer body 13. An annular lip 55 at the top of the sleeve 53 provides a stop that limits the upper travel of the central piston 16. An o-ring pressure seal 56 between the sleeve 53 and the body 13 cooperates with the pressure seal 52 to prevent pressure loss from the upper end of the chamber 18. The lower end of the piston 16 extends through a lower annular seal holder 57 that is equipped with an annular pressure seal 58 and a lower, annular wiper seal 59. O-ring seals 60 carded externally of the holder 57 cooperate with the seal 58 to maintain a pressure seal at the lower end of the chamber 18.

A replaceable annular flow restrictor 61 is threadedly engaged in the top of the piston 16. The central opening 62 through the flow restrictor 61 may be selected to increase or reduce the resistance to the flow of fluid through the central passage 15. An annular o-ring seal 63 between the restrictor 61 and the bore of the central piston 16 isolates the threaded area behind the restrictor from the dig fluids in the passage 15.

As illustrated in FIGS. 1 and 4, the base of the coil spring 17 is sealed on a spacer ring 64 that in turn rests on an internal lip 65 formed immediately above the timing gear 26. Oiling slots 66 (FIG. 4) formed along the base of the spacer ring 64 assist in permitting relative rotational movement between the timing gear and the spacer ring.

In operation, the centralizer 10 is positioned in a bottom-hole drilling assembly carried in a tubular drilling string.

The drilling assembly is deployed in a well bore where fluid is pumped down the drilling string through the centralizer 10 to a drill bit or other subsurface tool connected below the centralizer. Typically, the drill string is rotated from the well surface to rotate the drill bit in a conventional drilling procedure. The centralizer 10 may also be employed in a drilling or orienting assembly in which the bit is rotated by a subsurface mud motor and the drill string is employed to supply the pressurized drilling fluid. In either case, the centralizer 10 is designed to extend the three arms 33, 34 and 35 laterally out and away from the central axis of the tool and into engagement with the wall of the surrounding bore hole. Where rotation of the drill string assembly is required, the direction of rotation is clockwise, as viewed in FIGS. 2 and 3 to tend to fold the contact arms 33, 34 and 35 back toward the centralizer body and to prevent digging into the wall of the well bore. This orientation of the pivotal movement also ensures that the normal right-hand rotation of the drill string assembly will assist in retracting the contact arms when it is desired to withdraw the assembly to the well surface.

In the described application, with the centralizer 10 in a subsurface location within a well bore, drilling fluid pumped from the well surface flows through the flow passage 15 and elevates the fluid pressure in the passage 15 relative to the pressure existing outside of the centralizer. The effect of the flow of pressured drilling fluid through the passage 15 is to force the central piston 16 axially downwardly into the chamber 18. This action compresses the coil spring 17 and increases the hydraulic oil pressure in the chamber 18. During the axial movement of the piston 16, the wiper seals 51 and 59 remove drilling fluid from the internal sealing surfaces against which they slide while the pressure seals 52 and 58 maintain a sliding, sealing pressure engagement with the same surfaces to retain the hydraulic pressure in the chamber 18.

The pressure in the chamber 18 may be controlled, in part, by sizing the opening 62 through the restrictor to provide a predetermined resistance to the flow of drilling fluid through the tubular piston 16. Thus, for a given flow rate, viscosity and fluid pressure of drilling fluid flowing through the centralizer, the pressure in the chamber 18 may be increased or reduced by, respectively reducing or increasing the size of the opening 62 through the restrictor 61.

When the pressure of the hydraulic fluid in the chamber 18 is increased above that existing outside of the centralizer 10, the developing pressure differential across the o-ring seals 28 surrounding the lateral pistons 20, 21 and 22 forces the pistons to move laterally out and away from the central axis of the centralizer. The T-head connectors 31 push the non-pivoted ends of the contact arms 33, 34 and 35 out into the "open" position illustrated in FIG. 3. It will be appreciated that the arms 33, 34 and 35 will normally extend only until they engage the surrounding borehole wall, which will normally occur before they reach the full extension illustrated in FIG. 3.

Downward movement of the central tubular piston 16, in addition to increasing the pressure of the hydraulic oil in the chamber 18 and extending the arms 33, 34 and 35, also compresses the coil spring 17 to provide an energy storage system. When the drilling fluid pressure is sufficiently reduced, the stored energy in the compressed spring acts to push the central piston back to its uppermost position illustrated in FIG. 1. Because of the mechanical linkage of the piston splines 40, 41 and 42 in the timing gear grooves 43, 44 and 45, the timing gear 26 is forced to rotate in a counter-clockwise direction (FIG. 2) as the central piston returns to its original position. This counter-clockwise movement acts through the rack and pinion drive between the timing gear and the piston rods to retract the lateral pistons to the positions illustrated in FIG. 2. The mechanical linkage between the timing gear 26 and the central piston thus positively retracts the lateral pistons to in turn fully draw the contact arms into their closed positions.

A mechanical linkage other than the spline and groove arrangement described herein may suitably be employed provided only that the linkage is such that axial piston movement forces rotational timing gear movement. The preferred operation of the retraction mechanism of the present invention requires that the axial movement of the central piston 16 occurs without piston rotation so that the timing gear 26 is forced to rotate. In the described embodiment, rotation of the central piston is prevented by the frictional resistance to rotation exerted by the spring-biased contact of the ring 64 with the internal lip 65 and the tight fit of the pressure and wiper seals 52 and 51, respectively. It will be appreciated that the resistance to central piston rotation may be increased, for example, by rigidly bonding the top of the spring 17 to the piston 17 and bonding the bottom of the spring 17 to the body 13. Similarly, a pin extending radially outwardly from the base of the piston 16 into a downwardly developed slot in the central passage of the body 13, below the holder 57, would also prevent piston rotation without restricting axial movement.

From the foregoing it will be appreciated that the positive retraction design of the present invention provides improved performance as compared to a system relying primarily on the pressure differentials acting across the central pistons and the lateral pistons.

The foregoing disclosure and description of the invention is illustrative and explanatory thereof. It will be appreciated by those skilled in the art that various changes in the size, shape and materials, as well as in the details of the illustrated construction. The combinations of features and the method steps discussed herein may be made without departing from the spirit of the invention.

What is claimed is:

1. An extension and retraction mechanism for borehole drilling equipment comprising:

a tubular drilling tool extending axially along a central axis;

multiple extendable and retractable borehole contact members carried by said drilling tool and adapted to be moved laterally outwardly away from the central axis of said drilling tool in response to a first fluid pressure acting within said drilling tool;

a timing mechanism connecting said contact members to each other for coordinating the lateral movement of said contact members relative to each other; and an energy storage system acting through said timing mechanism and adapted to be energized by said first fluid pressure for subsequently employing stored energy for moving said contact members laterally inwardly toward the central axis of said drilling tool when said fluid pressure is decreased below said first fluid pressure; and a mechanical linkage operatively connected between said energy storage system and said timing mechanism whereby movement produced by said energy storage system produces movement of said timing mechanism.

2. An extension and retraction mechanism as defined in claim 1, wherein said energy storage system comprises:

a central, centrally mounted piston adapted to be moved axially within said drilling tool by said first fluid pressure; and a spring device adapted to be compressed by movement of said piston in response to said first fluid pressure and to move said piston in the opposite axial direction when said fluid pressure in said tool is reduced to a pressure lower than said first fluid pressure.

3. An extension and retracting tool as defined in claim 2, wherein:

said timing mechanism comprises a centrally disposed, rotatable wheel having circumferentially disposed gear teeth and a central, axially extending opening having internal grooves;

each of said borehole contact members engages lateral pistons having rods equipped with gear teeth for meshing engagement with said gear teeth of said timing mechanism whereby rotary movement of said wheel controls said lateral movement of said borehole contact member through movement of said lateral pistons; and external splines are formed on said centrally mounted piston and are adapted to engage and mesh with said central internal grooves in said wheel whereby axial movement of said centrally mounted piston through said wheel in one axial direction causes said wheel to rotate to laterally retract said contact members.

4. An extension and retraction mechanism as defined in claim 2, wherein said mechanical linkage comprises a mating, inclined spline and groove connection between said timing mechanism and said centrally mounted piston.

5. An extension and retraction mechanism as defined in claim 3, wherein:

a hydraulic fluid chamber is operatively connected with said central piston whereby axial movement of said central piston raises or lowers the pressure of hydraulic fluid in said chamber; and said lateral pistons are operatively connected with said chamber whereby said lateral pistons are moved laterally through said tool as the pressure of hydraulic fluid in said chamber is raised or lowered.

6. An extension and retraction mechanism as defined in claim 5, wherein:

a plurality of inclined splines are carried on a rod section of said central piston and mate with a plurality of internal inclined grooves formed in said rotatable wheel whereby axial, non-rotating movement of said central piston through said wheel forces said wheel to rotate and laterally move said borehole contact members.

7. An extension and retraction mechanism as defined in claim 1, wherein:

said contact members include pivoting arm members having first aid second arm ends;

said first arm ends are pivotably mounted to said tool whereby said second arm ends are adapted to be pivoted away from the central axis of said tool; and said second arm ends are connected to laterally movable piston actuators for moving said second arm ends laterally relative to the central axis of said tool.

8. An extension and retraction mechanism as defined in claim 2, wherein said central piston is restrained from rotating within said tool as said central piston is moved axially through said tool.

9. An extension and retraction mechanism as defined in claim 2, wherein:

said central piston comprises a piston head and a piston rod section; and said spring device comprises a coil spring encircling said piston rod section.

10. An extension and retraction mechanism as defined in claim 9, wherein said central piston is restrained from rotating within said tool as said central piston is moved axially through said tool.

11. An extension and retraction mechanism as defined in claim 11, wherein:

said central piston comprises a piston head and a piston rod section; and said spring device comprises a coil spring encircling said piston rod section.

* * * * *